US006568037B2

(12) United States Patent
Leder et al.

(10) Patent No.: US 6,568,037 B2
(45) Date of Patent: May 27, 2003

(54) APPARATUS FOR SEPARATING WASTE AND SHORT FIBERS FROM A CARDING CYLINDER

(75) Inventors: Armin Leder, Mönchengladbach (DE); Robert Többen, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/128,422

(22) Filed: Apr. 24, 2002

(65) Prior Publication Data

US 2002/0108215 A1 Aug. 15, 2002

Related U.S. Application Data

(63) Continuation of application No. 10/007,664, filed on Dec. 10, 2001.

(30) Foreign Application Priority Data

Dec. 11, 2000 (DE) ..... 100 61 651
Mar. 7, 2001 (DE) ..... 101 10 825

(51) Int. Cl.[7] ..... D01G 15/00

(52) U.S. Cl. ..... 19/98; 19/105; 19/200; 19/204

(58) Field of Search ..... 19/98, 99, 100, 19/101, 105, 106 R, 107, 108, 109, 112, 65 A, 65 R, 200, 202, 203, 204, 205

(56) References Cited

U.S. PATENT DOCUMENTS 3,169,278 A * 2/1965 Aoki ..... 19/105
4,527,307 A * 7/1985 Teichmann ..... 19/105
5,095,584 A 3/1992 Temburg
5,142,742 A 9/1992 Erni et al.
5,737,806 A * 4/1998 Leifeld et al. ..... 19/98
5,930,870 A * 8/1999 Leifeld et al. ..... 19/105
6,061,877 A * 5/2000 Leifeld et al. ..... 19/105
6,145,166 A 11/2000 Waeber et al.

FOREIGN PATENT DOCUMENTS

| | | |
|---|---|---|
| DE | 25 02 532 | 7/1975 |
| DE | 24 15 658 | 10/1975 |
| DE | 26 13 844 | 4/1977 |
| DE | 28 02 433 | 7/1978 |
| DE | 37 33 094 | 4/1989 |
| DE | 39 02 202 | 8/1990 |
| EP | 0 909 843 | 4/1999 |
| GB | 2 134 553 A | 8/1984 |
| GB | 2 200 376 A | 8/1988 |
| GB | 2 228 495 A | 8/1990 |

* cited by examiner

*Primary Examiner*—Gary L Welch
(74) *Attorney, Agent, or Firm*—Venable; Robert Kinberg; Stuart I. Smith

(57) ABSTRACT

A carding machine includes a main carding cylinder having a cylinder surface carrying a cylinder clothing thereon; a licker-in cooperating with the cylinder for transferring fiber material, including long and short fibers, from the licker-in to the carding cylinder; a doffer cooperating with the carding cylinder for transferring fiber material from the carding cylinder to the doffer; a cylinder cover extending circumferentially underneath the carding cylinder between the licker-in and the doffer; a force-exerting arrangement for applying, to the short fibers, a removing force greater than a retaining force exerted on the short fibers by the cylinder clothing carrying the fiber material; a waste outlet opening provided in the cylinder cover for discharging short fibers from the fiber material carried by the cylinder clothing; a suction hood coupled to the waste outlet opening for receiving the short fibers from the waste outlet opening.

17 Claims, 3 Drawing Sheets

APPARATUS FOR SEPARATING WASTE AND SHORT FIBERS FROM A CARDING CYLINDER

CROSS REFERENCE TO RELATED APPLICATIONS

This application is a continuation of Application Ser. No. 10/007,664 filed Dec. 10, 2001.

This application claims the priority of German Application No. 100 61 651.8 filed Dec. 11, 2000, which is incorporated herein by reference. Priority is also claimed to German Application No. 101 10 825.7 filed Mar. 7, 2001.

BACKGROUND OF THE INVENTION

This invention relates to an apparatus which is incorporated in a carding machine and which includes, between the doffer and the licker-in, cover elements underneath the main carding cylinder. Between the cover elements at least one discharge opening is provided through which trash and dust, separated from the fiber material, is introduced into a suction chamber.

In practice, on the cylinder clothing above the doffer fiber material is present which contains long (useful) and short fibers. Short fibers are undesired because they adversely affect the strength, particularly of fine yarns such as ring yarns. The doffer removes the preponderant portion of the fiber material from the main carding cylinder by means of its long clothing teeth. It is a disadvantage that in the doffed fiber material a substantial proportion of short fiber is present.

The main carding cylinder has a high circumferential velocity (in excess of 15 m/sec) and entrains a substantial quantity of air on its surface. This results in a vacuum at the carding cylinder in the circumferential region between the stationary cylinder cover and the rapidly moving cylinder clothing. The fibers are, on the other hand, retained and advanced by the teeth of the cylinder clothing and, on the other hand, held back by the above-noted vacuum on the cylinder surface. The fiber material is opened up to the individual fibers. In a known apparatus, as described in German patent document No. 39 02 202, to which corresponds U.S. Pat. No. 5,095,584, in the cover elements, between the doffer and the licker-in, openings are provided through which dust and, by centrifugal forces, heavy waste particles are separated. The lighter, short fibers, however, remain adhered to the cylinder clothing, particularly under the effect of the clothing teeth and the vacuum in the clothing.

SUMMARY OF THE INVENTION

It is an object of the invention to provide an apparatus of the above-outlined type from which the discussed disadvantages are eliminated and which, in particular, makes possible a substantial reduction in the short fiber proportion of the fiber removed from the cylinder by the doffer and thus permits the manufacture of a stronger yarn.

These objects and others to become apparent as the specification progresses, are accomplished by the invention, according to which, briefly stated, the carding machine includes a main carding cylinder having a cylinder surface carrying a cylinder clothing thereon; a licker-in cooperating with the carding cylinder for transferring fiber material, including long and short fibers, from the licker-in to the carding cylinder; a doffer cooperating with the carding cylinder for transferring fiber material from the carding cylinder to the doffer; a cylinder cover extending circumferentially underneath the carding cylinder between the licker-in and the doffer; a force-exerting arrangement for applying, to the short fibers, a removing force greater than a retaining force exerted on the short fibers by the cylinder clothing carrying the fiber material; a waste outlet opening provided in the cylinder cover for discharging short fibers from the fiber material carried by the cylinder clothing; a suction hood coupled to the waste outlet opening for receiving the short fibers from the waste outlet opening.

By virtue of the measures according to the invention, on the teeth of the doffer clothing preferably the longer fibers remain attached so that the fiber material which remains on the cylinder clothing after contact with the doffer—that is, the fiber material which is not doffed—has a significantly higher short fiber proportion. The short fibers which at that location are opened into individual fibers and are as such situated on the cylinder clothing, are retained by the teeth of the cylinder clothing. By virtue of the fact that the separating force exerted on the short fibers is greater than the retaining force of the cylinder clothing, the short fibers are substantially entirely removed by suction. As a result, undesired short fibers are not introduced—as the cylinder continues to rotate—in the new fiber material advanced by the licker-in to the carding cylinder and thus do not arrive to the doffer. The totality of the good (long) fibers processed in the carding machine is thus to a significant measure freed from short fibers.

DESCRIPTION OF THE PREFERRED EMBODIMENTS

Figure 1:
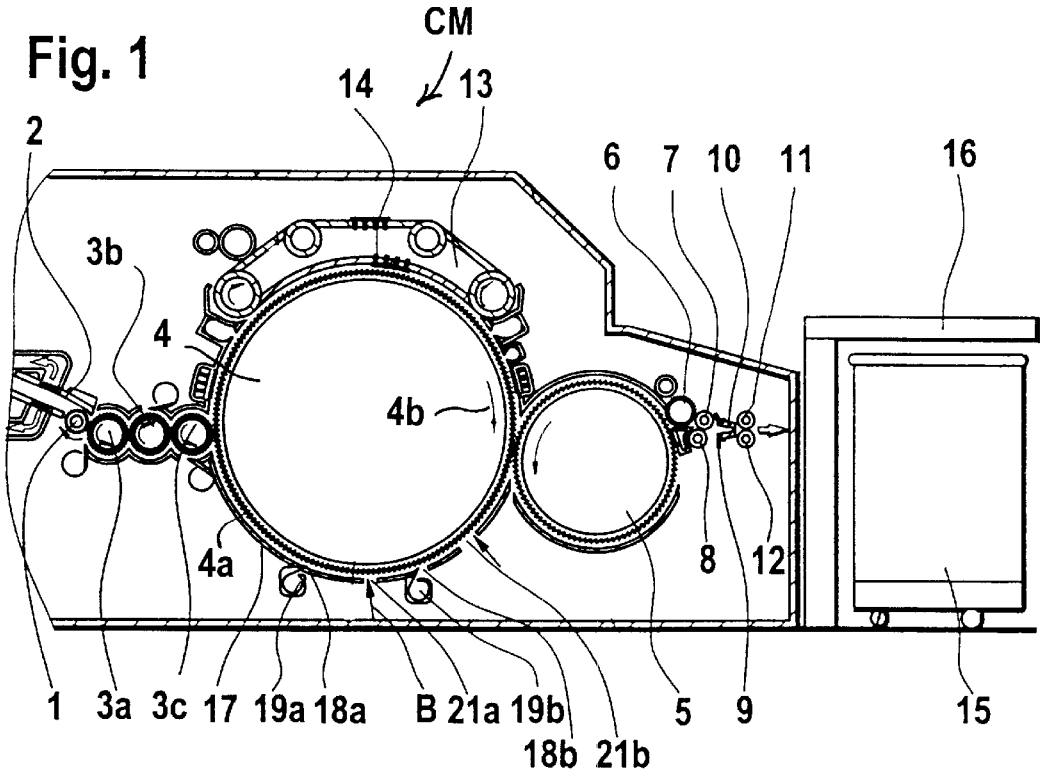
FIG. 1 is a schematic side elevational view of a carding machine incorporating the invention.

FIG. 1 shows a carding machine which may be, for example, an EXACTACARD DK 803 model, manufactured by Trützschler GmbH & Co. KG, Mönchengladbach, Germany. The carding machine CM has a feed roller 1, a feed table 2 cooperating therewith, licker-ins 3*a*, 3*b*, 3*c*, a main carding cylinder 4 rotating in the direction 4*b*, a doffer 5, a stripping roll 6, crushing rolls 7, 8, a web guiding element 9, a web trumpet 10, calender rolls 11, 12, a traveling flats assembly 13 having flat bars 14, a coiler can 15 and a sliver coiler 16.

Underneath the cylinder 4, between the doffer 5 and the licker-in 3*c*, a cylinder cover 17 is disposed which has two waste outlet openings 18*a* and 18*b* leading into respective suction chambers 19*a* and 19*b*. The waste outlet openings 18*a* and 18*b* are preceded—as viewed in the direction of rotation 4*b* of the cylinder 4—by an air inlet opening 21*a* and an air outlet opening 21*b*, respectively.

Figure 2A:
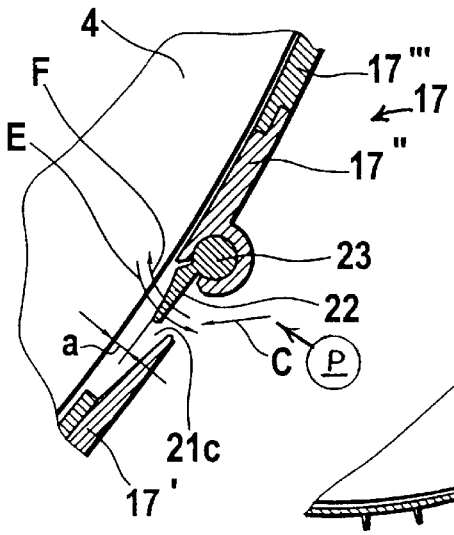
FIG. 2*a* is an enlarged detail of FIG. 2.
Figure 2:
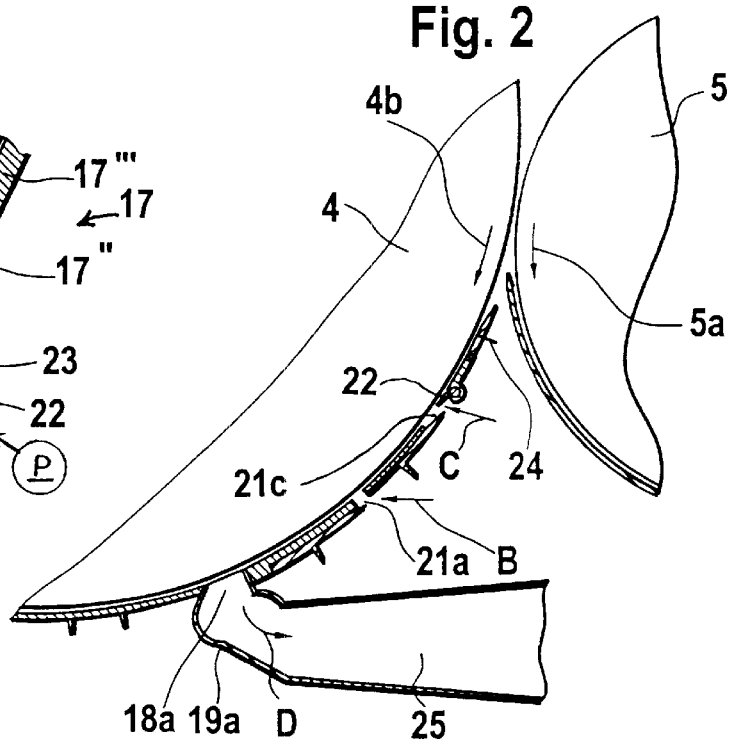
FIG. 2 is a schematic side elevational view of a preferred embodiment of the invention.

Turning to FIGS. 2 and 2*a*, in which the rotational direction of the doffer 5 is shown by arrow 5*a*, the cover 17 is composed of a plurality of cover elements 17', 17", 17'".

The waste outlet opening 18*a* is preceded by the air inlet opening 21*a* and a further air inlet opening 21*c*. While a non-regulated air stream B enters from the atmosphere through the air inlet opening 21*a*, an air stream C which enters through the air inlet opening 21*c* is regulated. For this purpose an air guiding element 22 is provided which has a cylindrical bearing head 23 held in the cover part 17" for rotation in the direction of the arrows E, F. The other end of the air guiding element 22 is oriented in the rotary direction 4*b* of the cylinder 4. By virtue of this arrangement the flow passage of the air inlet opening 21*c* may be gradually widened or narrowed. The air stream C is either naturally aspirated by the vacuum produced by the rapid rotation of the carding cylinder 4 or is generated by an air pressure source P which may be regulated.

The air inlet opening 21*c* is preceded by a pressure measuring element 24 with which the static air pressure underneath the cylinder cover 17 (that is, in the clearance between the cover 17 and the cylinder clothing 4*a*) is measured. For this purpose a through bore is provided in the cover 17. The measured pressure magnitudes are utilized for regulating the position of the air guiding element 22. The angular position of the air guiding element 22 may thus be automatically regulated or, as it is also feasible, it may be manually set.

During operation, through the air inlet openings 21*a* and 21*c,* respective air streams B and C are drawn from the atmosphere by means of the vacuum prevailing in the gap between the cylinder cover 17 and the cylinder surface and, as noted earlier, may be produced by a source of pressurized air. The air streams B and C impinge on the short fibers carried by the cylinder clothing 4*a* and loosen the hold of the clothing 4*a* on such short fibers. Thereafter, the short fibers are drawn through the waste outlet opening 18*a* into the suction chamber 19*a* and are removed via a conduit 25 which is coupled to a non-illustrated vacuum source. By means of the inflowing air streams B and C which exert a pressure on the short fibers and the vacuum stream D which exerts a pulling force on the short fibers, the removal force on the short fibers is greater than the retaining force of the cylinder clothing 4*a*. In this manner, the short fibers are removed from the cylinder clothing to a greater extent than the long fibers still present on the cylinder clothing.

Figure 3:
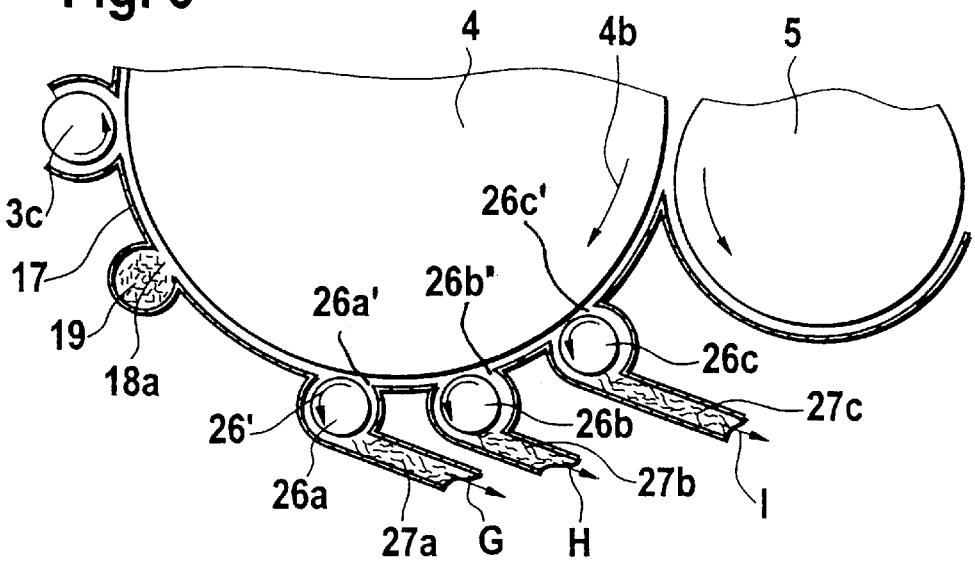
FIG. 3 is a schematic side elevational view of a further embodiment of the invention.
Figure 4:
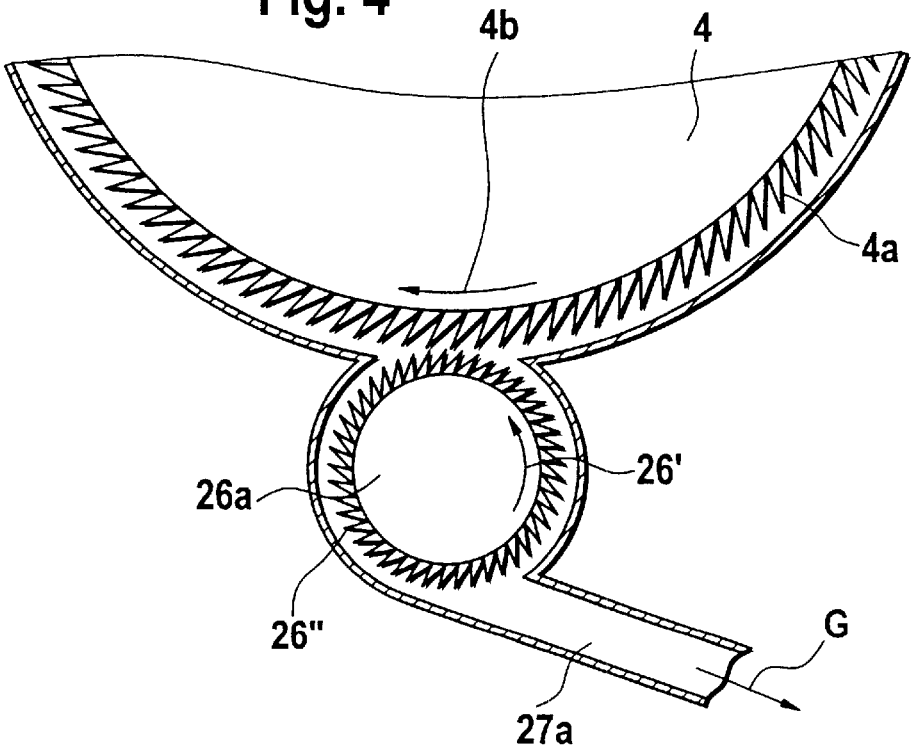
FIG. 4 is an enlarged detail of FIG. 3.

Turning to FIGS. 3 and 4, between the doffer 5 and the licker-in 3*c*, three circumferentially mutually spaced doffer rolls (removal rolls) 26*a*, 26*b* and 26*c* are arranged in respective outlet openings 26*a*', 26*b*' and 26*c*' adjacent to and in cooperation with, the carding cylinder 4. Each doffer roll, rotating in the direction of the arrow 26', has a diameter of 120 mm and a circumferential velocity of 3.5 m/sec and each has, as shown in the enlarged FIG. 4 for the doffer roll 26*a*, a clothing 26" whose teeth are inclined against the rotary direction 26'. The teeth of the cylinder clothing 4*a* are directed in the rotary direction 4*b* of the carding cylinder 4. Stated differently, in the region of cooperation between the cylinder clothing 4*a* and the roll clothing 26", the cylinder clothing teeth and the roll clothing teeth are oppositely inclined. By virtue of this arrangement, the doffer rolls 26*a*, 26*b* and 26*c* take off the longer fibers from the cylinder clothing 4*a* which are carried away by respective suction streams G, H and I in conduits 27*a*, 27*b* and 27*c*, respectively. Thus, the fiber material on the cylinder clothing 4*a* is free from a substantial part of long fibers at locations downstream of the removal roll 26*a* as viewed in the rotary direction 4*b* of the cylinder 4. As a result, the fiber material carried by the cylinder 4 contains preponderantly short fibers downstream of the removal roll 26*a*. In the cover 17, between the removal roll 26*a* and the licker-in 3*c*, the waste outlet opening 18*a* is provided, through which the short fibers enter into the suction chamber 19. Since the fiber material on the cylinder clothing 4*a* is "thinned out" with respect to long fibers, that is, the short fibers are in preponderance, a suction removal of the short fibers is facilitated.

Figure 5:
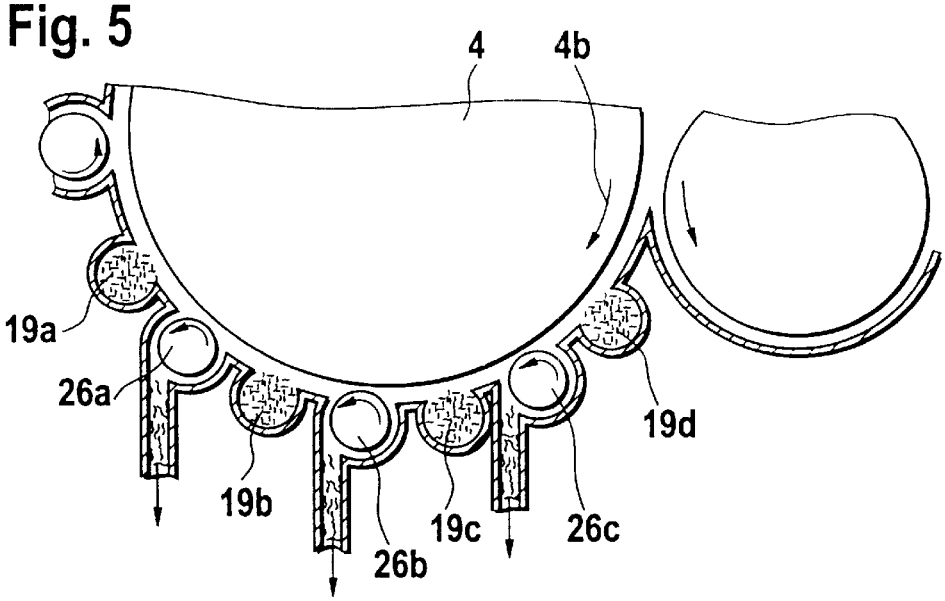
FIG. 5 is a variant of the structure shown in FIG. 3.

FIG. 5 illustrates an embodiment in which the principle of air intake is combined with the principle of fiber removal. As viewed against the rotary direction 4*b* of the carding cylinder 4, underneath the carding cylinder 4 there are provided a suction chamber 19*a,* a removal roll 26*a,* a suction chamber 19*b,* a removal roll 26*b,* a suction chamber 19*c,* a removal roll 26*c* and a suction chamber 19*d*. Preceding each suction chamber 19*a*–19*d*, in the cover 17 a respective through opening is provided which extends over the width of the machine (that is, the over axial length of the carding cylinder).

Figure 6:
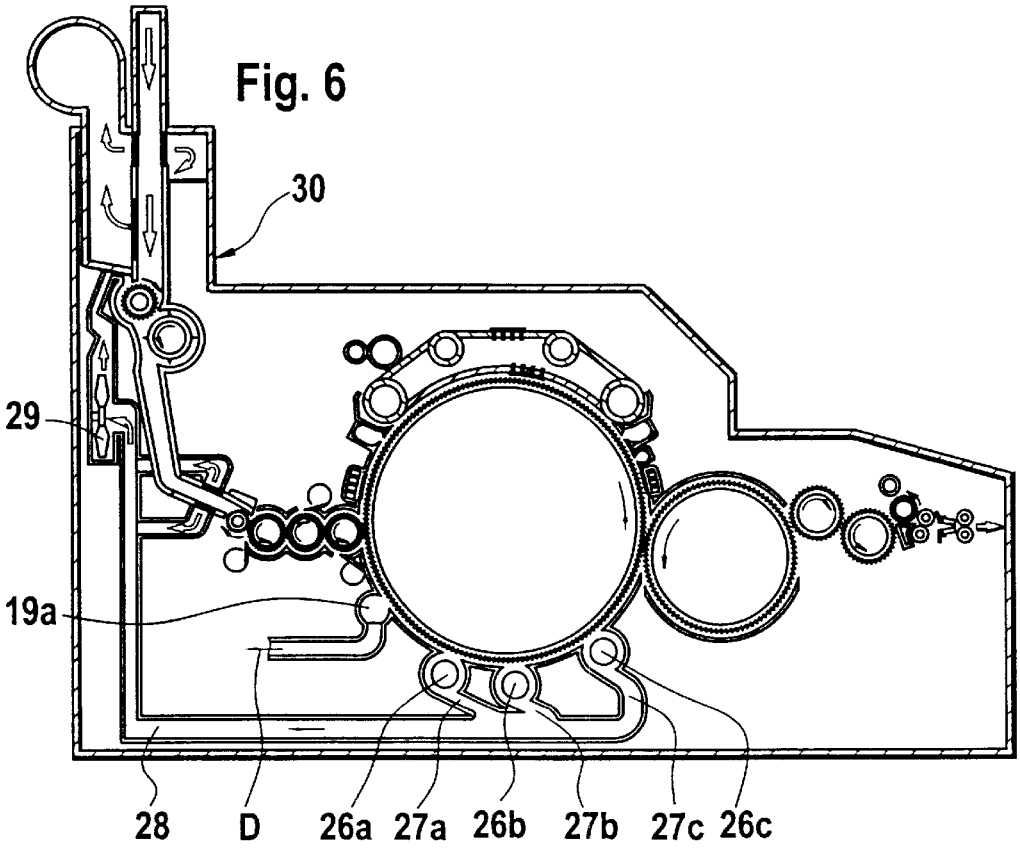
FIG. 6 is a schematic side elevational view of the embodiment similar to FIG. 3 illustrating a recirculation of the longer fibers into a fiber feeder.

In the embodiment according to FIG. 6 the suction channels 27*a,* 27*b* and 27*c* for the long fibers are coupled to a common pneumatic collecting conduit 28 which leads to the suction side of a fan 29 integrated in a known manner into the air circuit of a card feeder 30 for the carding machine. In this manner, the long fibers are reintroduced into the card feeder. The short fibers removed through the suction chamber 19*a* are taken away by a non-illustrated waste collector.

It will be understood that the above description of the present invention is susceptible to various modifications, changes and adaptations, and the same are intended to be comprehended within the meaning and range of equivalents of the appended claims.

What is claimed is:

1. A carding machine comprising:

(a) a main carding cylinder having a cylinder surface carrying a cylinder clothing thereon;

(b) a licker-in cooperating with said carding cylinder for transferring fiber material, including long and short fibers, from said licker-in to said carding cylinder;

(c) a doffer cooperating with said carding cylinder for transferring fiber material from said carding cylinder to said doffer;

(d) a cylinder cover extending circumferentially underneath said carding cylinder between said licker-in and said doffer;

(e) force-exerting means for applying, to the short fibers, a removing force greater than a retaining force exerted on the short fibers by the cylinder clothing carrying the fiber material;

(f) a waste outlet opening provided in said cylinder cover for discharging short fibers from said fiber material carried by the cylinder clothing; and (g) a suction hood coupled to said waste outlet opening for receiving the short fibers from said waste outlet opening.

2. The carding machine as defined in claim 1, wherein said carding cylinder has a direction of rotation; further comprising:

(h) an additional outlet opening provided in said cylinder cover upstream of said waste outlet opening as viewed in said direction of rotation; and (i) a rotary removal roll disposed in said additional outlet opening and cooperating with said carding cylinder for removing long fiber therefrom.

3. The carding machine as defined in claim 2, in combination with a card feeder supplying fiber material to said licker-in; further comprising a duct connecting said additional outlet opening with said card feeder for reintroducing in said card feeder long fibers separated from said carding cylinder by said rotary removal roll.

4. The carding machine as defined in claim 2, wherein said rotary removal roll has a sawtooth clothing.

5. The carding machine as defined in claim 4, wherein teeth of said cylinder clothing have a first direction of inclination; further wherein said rotary removal roll has a sawtooth clothing whose teeth have a second direction of inclination; and further wherein at a location of cooperation between said carding cylinder and said removal roll said first and second directions of inclination are oppositely oriented.

6. A carding machine comprising:

(a) a main carding cylinder having a direction of rotation and a cylinder surface carrying a cylinder clothing thereon;

(b) a licker-in cooperating with said cylinder for transferring fiber material, including long and short fibers, from said licker-in to said carding cylinder;

(c) a doffer cooperating with said cylinder for transferring fiber material from said carding cylinder to said doffer;

(d) a cylinder cover extending circumferentially underneath said carding cylinder between said licker-in and said doffer;

(e) an air inlet opening provided in said cylinder cover for introducing an air stream into a space between said cylinder cover and said cylinder clothing for exerting, on the short fibers, a removing force greater than a retaining force exerted by the cylinder clothing carrying the fiber material;

(f) a waste outlet opening provided in said cylinder cover downstream of said air inlet outlet opening as viewed in said direction of rotation for discharging short fibers removed from said cylinder clothing by the air stream; and (g) a suction hood coupled to said waste outlet opening for receiving the short fibers from said waste outlet opening.

7. The carding machine as defined in claim 6, further comprising a source of pressurized air connected to said air inlet opening.

8. The carding machine as defined in claim 6, further comprising a pressure sensing element for measuring a static pressure prevailing in a space between said cylinder cover and said carding cylinder.

9. The carding machine as defined in claim 6, further comprising control means for controlling a flow rate of the air stream passing through said air inlet opening.

10. The carding machine as defined in claim 9, wherein said control means comprises means for varying a flow passage area of said air inlet opening.

11. The carding machine as defined in claim 9, wherein said control means comprises an air guiding element movably secured at said cylinder cover for varying a flow passage area of said air inlet opening.

12. The carding machine as defined in claim 9, wherein said control means comprises an air guiding element movably secured at said cylinder cover for varying a clearance between said air guiding element and said carding cylinder.

13. The carding machine as defined in claim 12, further comprising a pressure sensing element for measuring a static pressure prevailing in a space between said cylinder cover and said carding cylinder for setting said air guiding element.

14. A carding machine comprising:

(a) a main carding cylinder having a direction of rotation and a cylinder surface carrying a cylinder clothing thereon;

(b) a licker-in cooperating with said carding cylinder for transferring fiber material, including long and short fibers, from said licker-in to said carding cylinder;

(c) a doffer cooperating with said carding cylinder for transferring fiber material from said carding cylinder to said doffer;

(d) a cylinder cover extending circumferentially underneath said carding cylinder between said licker-in and said doffer;

(e) a waste outlet opening provided in said cylinder cover for discharging short fibers from said fiber material carried by the cylinder clothing;

(f) a suction hood coupled to said waste outlet opening for receiving the short fibers from said waste outlet opening;

(g) an additional outlet opening provided in said cylinder cover upstream of said waste outlet opening as viewed in said direction of rotation; and (h) a rotary removal roll disposed in said additional outlet opening and cooperating with said carding cylinder for removing long fiber therefrom.

15. The carding machine as defined in claim 14, wherein said rotary removal roll has a sawtooth clothing.

16. The carding machine as defined in claim 15, wherein teeth of said cylinder clothing have a first direction of inclination; further wherein said rotary removal roll has a sawtooth clothing whose teeth have a second direction of inclination; and further wherein at a location of cooperation between said carding cylinder and said removal roll said first and second directions of inclination are oppositely oriented.

17. The carding machine as defined in claim 14, in combination with a card feeder supplying fiber material to said licker-in; further comprising a duct connecting said additional outlet opening with said card feeder for reintroducing in said card feeder long fibers separated from said carding cylinder by said rotary removal roll.

* * * * *